US007950497B2

(12) United States Patent
Horton

(10) Patent No.: US 7,950,497 B2
(45) Date of Patent: May 31, 2011

(54) LADDER STABILISING DEVICE

(75) Inventor: Peter Donald Horton, Donvale (AU)

(73) Assignee: Surrey Hills Hire Pty. Ltd. (AU)

( * ) Notice: Subject to any disclaimer, the term of this patent is extended or adjusted under 35 U.S.C. 154(b) by 954 days.

(21) Appl. No.: 10/902,693

(22) Filed: Jul. 29, 2004

(65) Prior Publication Data

US 2006/0032185 A1 Feb. 16, 2006

(51) Int. Cl.
*E06C 7/42* (2006.01)

(52) U.S. Cl. ..... 182/107

(58) Field of Classification Search ..... 182/107, 182/214

See application file for complete search history.

(56) References Cited

U.S. PATENT DOCUMENTS

| | | | | |
|---|---|---|---|---|
| 1,508,392 | A * | 9/1924 | Heun | 182/214 |
| 4,519,477 | A | 5/1985 | Ralston | |
| 5,551,529 | A | 9/1996 | Molitor | |
| 5,628,381 | A * | 5/1997 | Markovich et al. | 182/107 |
| 5,775,465 | A | 7/1998 | Vossler | |
| 6,029,774 | A | 2/2000 | Cothern | |
| 6,722,469 | B1 * | 4/2004 | Weger, Jr. | 182/107 |
| 2002/0134619 | A1 | 9/2002 | Schwenke | |
| 2005/0045421 | A1 * | 3/2005 | Gaines | 182/107 |

FOREIGN PATENT DOCUMENTS

| | | |
|---|---|---|
| AU | 2001100506 | 11/2001 |
| DE | 29901201 | 9/1999 |
| EP | 1087098 | 3/2001 |
| GB | 2232710 | 12/1990 |

* cited by examiner

*Primary Examiner* — Alvin C Chin-Shue

(74) *Attorney, Agent, or Firm* — Andrus, Sceales, Starke & Sawall, LLP

(57) ABSTRACT

The invention relates to a device 10 for stabilising ladders 60 that bridge a floor 70 and an elevated structure, such as an elevated floor 70 in a multi-storey construction. The device 70 includes a body that is fixable to the elevated structure and an arm 50 extending from the body. The arm 50 has a tab 52 which engages a beam 64 of the ladder 60 when the ladder 60 is abutting an edge 40 of the body. In this arrangement, outward sliding movement of a heel of the ladder is prevented and thus the ladder 60 is stabilised.

27 Claims, 2 Drawing Sheets

LADDER STABILISING DEVICE

FIELD OF THE INVENTION

This invention relates to a safety device used, primarily but not exclusively, in construction sites. In particular, the invention concerns a device for stabilising a ladder that bridges floors on a construction site.

BACKGROUND OF THE INVENTION

A common problem in multi-storey construction sites is the safe passage of workers between floors where a set of stairs is not yet installed. A ladder is most commonly preferred for this purpose despite the risks inherent with the ladder shifting under the weight of the worker during use.

Typically during use, erected ladders have a tendency for the ladder heel to slide across a floor so that the ladder inclination diminishes, the ladder thereby loosing contact with the elevated floor. One attempt at redressing this problem has been the use of rubber-covered heels or shoes on the ladder to grip the floor. However, the effectiveness of the rubber-covered heels or shoes is significantly diminished where the floor is covered in loose particles, such as sawdust, which may enable the ladder feet to slide across the floor.

Another problem arises where the ladder is placed on uneven ground such that one heel or shoe of one leg of the ladder may swing freely, thus causing the ladder to rotate unpredictably under a worker's weight. Alternatively, the upper end of the ladder, which rests against an upper floor of the building under construction, may slide laterally, thus resulting in either the ladder toppling over or the weight of the ladder and worker being unevenly distributed between the heels of the ladder. In the latter case, the ladder may freely and unpredictably rotate as it is not optimally stabilised.

A less common, but ever present, risk is where a worker on the ladder overbalances beyond vertical such that the ladder falls directly away from the elevated floor. Usually this is the result of a ladder shifting, for instance, due to the heels slipping or the ladder being placed on uneven ground.

The object of the invention is, therefore, to improve the stability of a ladder bridging vertically spaced sites, in a construction site.

SUMMARY OF THE INVENTION

The invention provides in a first aspect a ladder stabilising device including:

- a body engageable stably with an element of a structure at or adjacent a location where the structure or body defines an abutment for a rear face of a ladder; and
- means projecting from said body and having a portion positioned to engage a front face of said ladder at such a position that said engaged portion and said abutment co-operate to limit outward sliding movement of the heel of the ladder.

Preferably said element of the structure is an elevated element, relative to the ground or floor on which said heel of the ladder rests. In this case, said projecting means preferably projects outwardly and downwardly when said body is engaged with said element of the structure.

The projecting means may comprise an arm extending from the body and detent means, e.g. a tab or lug, on the arm for engaging the ladder. The detent means is preferably shaped to engage a first leg or beam of the ladder and additionally may include a return which, in combination with the arm, defines a first slot in which the leg of the ladder is receivable. The slot assists to prevent lateral movement of the ladder out of engagement with the detent means. The detent means is preferably spaced from the body by a distance which facilitates insertion of a ladder into the device, but yet optimises the weight and strength of the device. Preferably, the arm is 30 to 100 cm long, e.g. about 40-45 cm. The detent means is preferably set relative to the body to provide a predetermined initial ladder inclination in the range of 9-20° from vertical.

In order to ensure that the ladder can be easily positioned in engagement with the stabiliser device, the return extends from the detent means by a distance which enables rungs of the ladder, when the leg of the ladder is engaged by the detent means, to pass the return without interference, but prevents the leg moving out of the slot due to lateral movement of the ladder.

The body of the stabiliser device may include at least one plate having apertures through which fastening means pass to enable the at least one plate to be fastened to the aforesaid elevated element of the structure. A pair of plates, dimensioned and connected together to be respectively fastened to a floor surface and a joist, preferably form the body of the stabiliser device. In particular, the plates may be linked such that the floor-engaging plate defines an overhanging edge that forms said abutment for the ladder. The edge is preferably spaced from the joist-engaging plate to accommodate upper ends of legs of a lower portion of an extension ladder.

Preferably, said body further includes means fixed to, or adapted to be fixed to, said body to limit lateral movement of said ladder. Such means may comprise, for example, a formation defining a second slot on the body, e.g. on said at least one plate, to receive a leg of the ladder. In one preferred arrangement, such formation may be a lug or other projection positioned to define the slot between the lug or other projection and the projecting means.

The floor-engaging plate may include an aperture through which means may be threaded and passed about a second leg of the ladder, between rungs, whereby to loosely secure the second leg to the stabiliser device. Preferably, the threaded means is a chain securable in a loop by a lock. It should be appreciated that securing the second leg assists in limiting or controlling twisting movement of the ladder in use, i.e. where the ladder pivots uncontrollably on one leg. Moreover, securing the ladder to the stabiliser device provides security against pilfering of the ladder, thus enabling the permanent erection of the ladder throughout the course of construction.

A second aspect of the invention provides a stabilised ladder installation comprising:

- a ladder stabiliser device according to the first aspect of the invention secured to a first element of a structure at a workspace elevated from a second workspace; and
- a ladder engaged with said abutment and with said projecting means so as to stabilise the ladder substantially at a predetermined inclination.

BRIEF DESCRIPTION OF THE DRAWINGS

An embodiment of the invention will now be described, by way of example only, with reference to the accompanying drawings, in which.

DESCRIPTION OF THE PREFERRED EMBODIMENT

Figure 1:
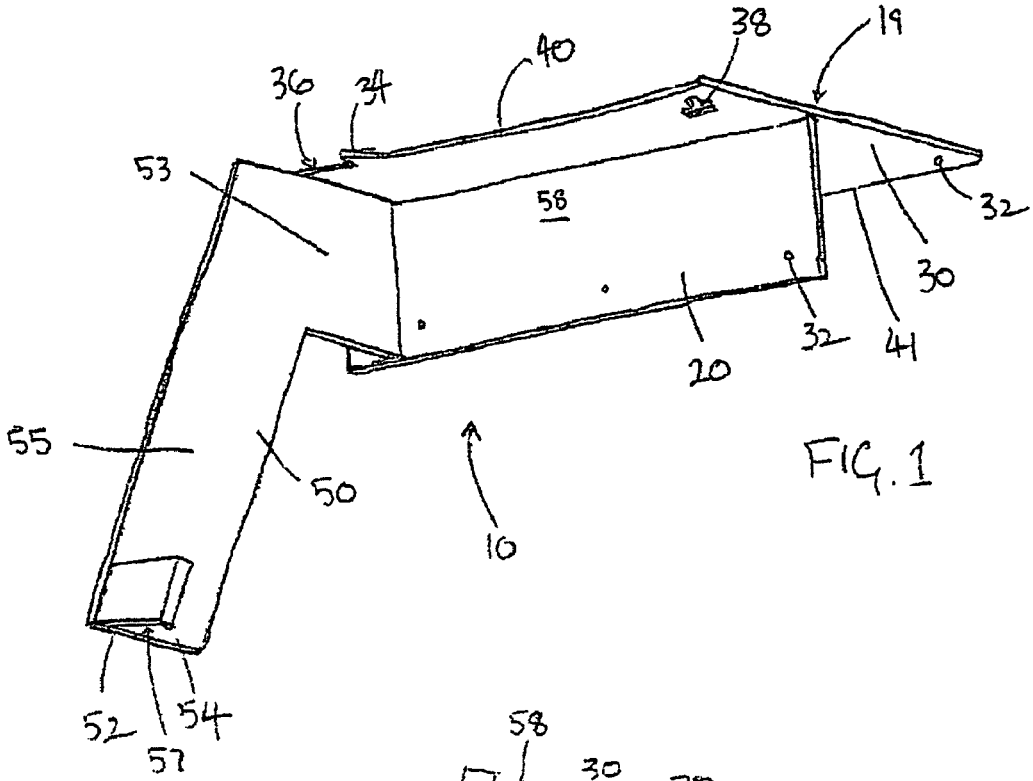
FIG. 1 is a right side perspective view of the underside of an embodiment of ladder stabiliser device according to the invention.

In the illustrated embodiment, a ladder stabiliser device 10, hereinafter referred to as ladder stabiliser 10, has a body in the form of anchor plate assembly 19. Assembly 19 comprises a pair of plates 20, 30 abutted and welded in a right angular configuration, with plate 20 for depending from plate 30 and extending parallel to and spaced from a front edge 40 of plate 30. Plate 20 abuts plate 30 nearer to edge 40 than to the opposite edge 41 of plate 30. The stabiliser 10 also has a projecting means in the form of an arm 50, with a detent tab 52 at its outer end. The arm 50 further includes a brace 56 (FIG. 3) for strengthening the arm 50 against lateral movement.

Figure 2:
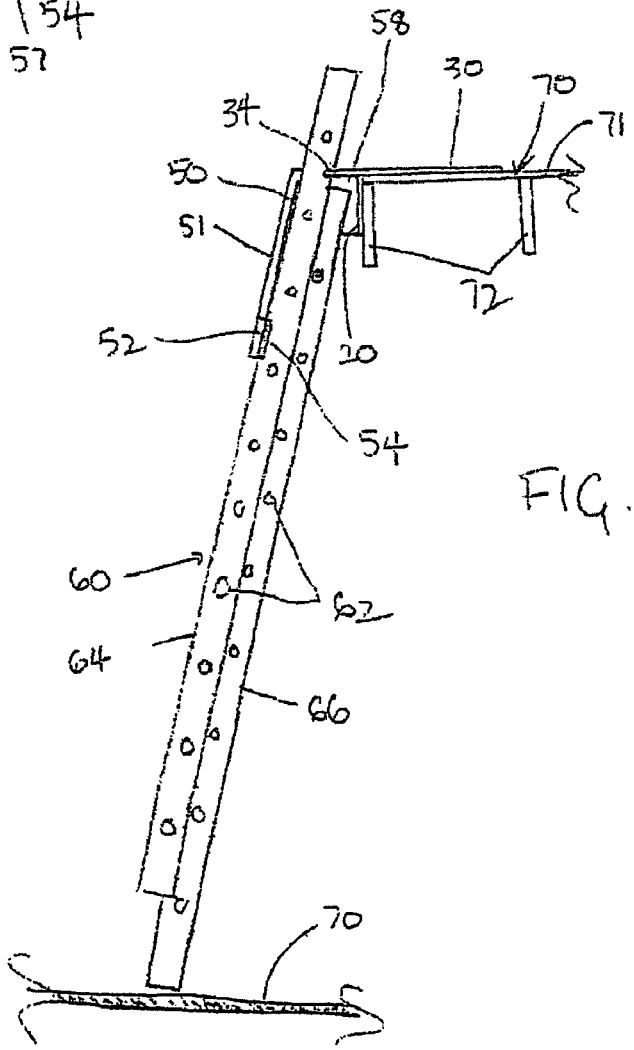
FIG. 2 is a cross-sectional view of the stabiliser device illustrated in FIG. 1 in situ with an extension ladder engaged with the device.

The plates 20, 30 are both formed from 4 mm steel sheet and both include apertures 32 which enable the passage of screws, bolts or the like fastening means therethrough such that the plate assembly 19 can be securely and stably fastened to a suitable support. In a typical application, the support, as shown in FIG. 2, is provided by an elevated floor 70 of a structure such as a building. Floor 70 includes an end joist 72 and the assembly 19 is fastened with panel 30 fixed to the floor surface 71 and plate 20 to the front of joist 72.

In an alternative embodiment, the anchor plate assembly 19 includes a return plate extending from the lower edge of plate 20 and parallel to plate 30 to define a channel for receiving the perimeter of the elevated floor 70. The return plate may include apertures through which fastening means is extendible to fasten the return plate to the underside of the elevated floor 70.

The plate 30 is dimensioned to provide the stabiliser with strength and also acts to counterbalance the weight of the extending arm 50. This enables a single worker to install the stabiliser 10 at a desired location without the assistance of a second worker holding the stabiliser 10 in place while the first worker attends to the fasteners.

Arm 50 is cut as an integral flat piece from steel sheet and has a first upper portion 53 of similar width to plate 20, projecting at right angles from plate 20 closely adjacent to, but spaced from, one end 18 of plate 20. This portion 53 is welded at its end edge to plate 20 and at its top edge to overlying plate 30. Portion 53 projects beyond edge 40 of plate 30. Arm 50 further has an outwardly and downwardly extending portion 55 of uniform width, and detent tab 52 is welded to plate portion 55 at its lower front edge. Tab 52 protrudes at right angles from arm portion 55 on the side of the arm opposite end 18 of plate 20, and terminates in a return lip 54.

Once secured in position on floor 70, the stabiliser 10 is ready to receive a ladder 60. A leg or beam 64 of the ladder 60 is inserted up through the space between the tab 52 and edge 40. The tab 52 is set at a distance spaced from the plate assembly 19 to optimise the ease of inserting a ladder. Were the tab 52 to be located further up the arm nearer plate 30, the space between the tab 52 and edge 40 becomes narrow and increases the difficulty of inserting the ladder 60. Alternatively, were the tab 52 to be further away from the plate 30, (i.e. were arm 50 to be longer), the concomitant weight increase associated with lengthening the arm 50 becomes undesirable. Accordingly, outer edge 51 of the arm portion 55 has a length in the range 40 to 50 cm, but optimally about 45 cm.

With edge 40 serving as an abutment for the rear faces of ladder beams 64, and with the side of the ladder also abutting the arm 50, heel 68 of the ladder is drawn along the floor 70 away from the stabiliser 10 (by pivoting the ladder about the abutment at edge 40) such that a beam 64 of the ladder 60 contacts the tab 52. At this point, the heel 68 cannot be withdrawn further as pivoting of the beam 64 about the edge 40 is prevented by the tab 52, and the ladder is therefore set at an initial inclination determined by the relative positions of the tab 52 and edge 40. Current building regulations require this inclination to be 14° from vertical, but it may otherwise be in the range of 9-200° from vertical.

The rigidity of the arm 50 and tab 52 prevent pivoting of the beam 64 about the edge 40 by arresting the outward displacement of the beam 64 relative to the stabiliser 10. In this manner, any movement of the beam 64 is met with a corresponding opposing force from the stabiliser 10 via the arm 50 and tab 52 which resists further movement, thus stabilising the ladder 60 at its initial inclination. Put another way, tab 52 and edge 40 cooperate to prevent or limit outward sliding movement of the heel of the ladder.

Lateral sliding of the ladder 60 along the edge 40 is prevented by the arm 50 abutting the beam 64 and by a lug 34 located on the edge 40 to define with arm portion 53, a slot or gap 36 in which the beam 64 rests. The return lip 54 on the plate 52 further assists to prevent lateral sliding movement by defining a slot 57 in which the beam 64 is also received. The lip 54 is shaped such that it does not interfere with rungs 62 as the ladder is inserted in or removed from the stabiliser 10. It will be further appreciated that the tab 52 also prevents the ladder 60 rotating about the heel of the other beam because beam 64 is restrained by the co-operation of the edge 40 and plate 52.

The plate 30 further includes a T-shaped hole 30 through which a chain, or other suitable restraining means may be threaded and then looped around an adjacent beam of the ladder 60, between adjacent rungs 62. The T-shape enables the perpendicularly arranged chain links to pass through the opening 30. However, the T-shape also restricts chain movement by placing one link in the downstroke of the T such the next link is prevented from moving through the opening 38 in the same place.

With a padlock securing the ends of the chain, the ladder 60 is prevented from rotating about beam 64 held by tab 52, and furthermore is locked to the stabiliser 10 to prevent theft of the ladder 60 where it is left on the construction site outside work hours. The provides a convenience for workers as the ladders can remain permanently erected on the construction site for the time required. This avoids the need to remove the ladder 60 each day for safe storage after work is completed and erect the ladder 60 the next day when the workers return.

Figure 3:
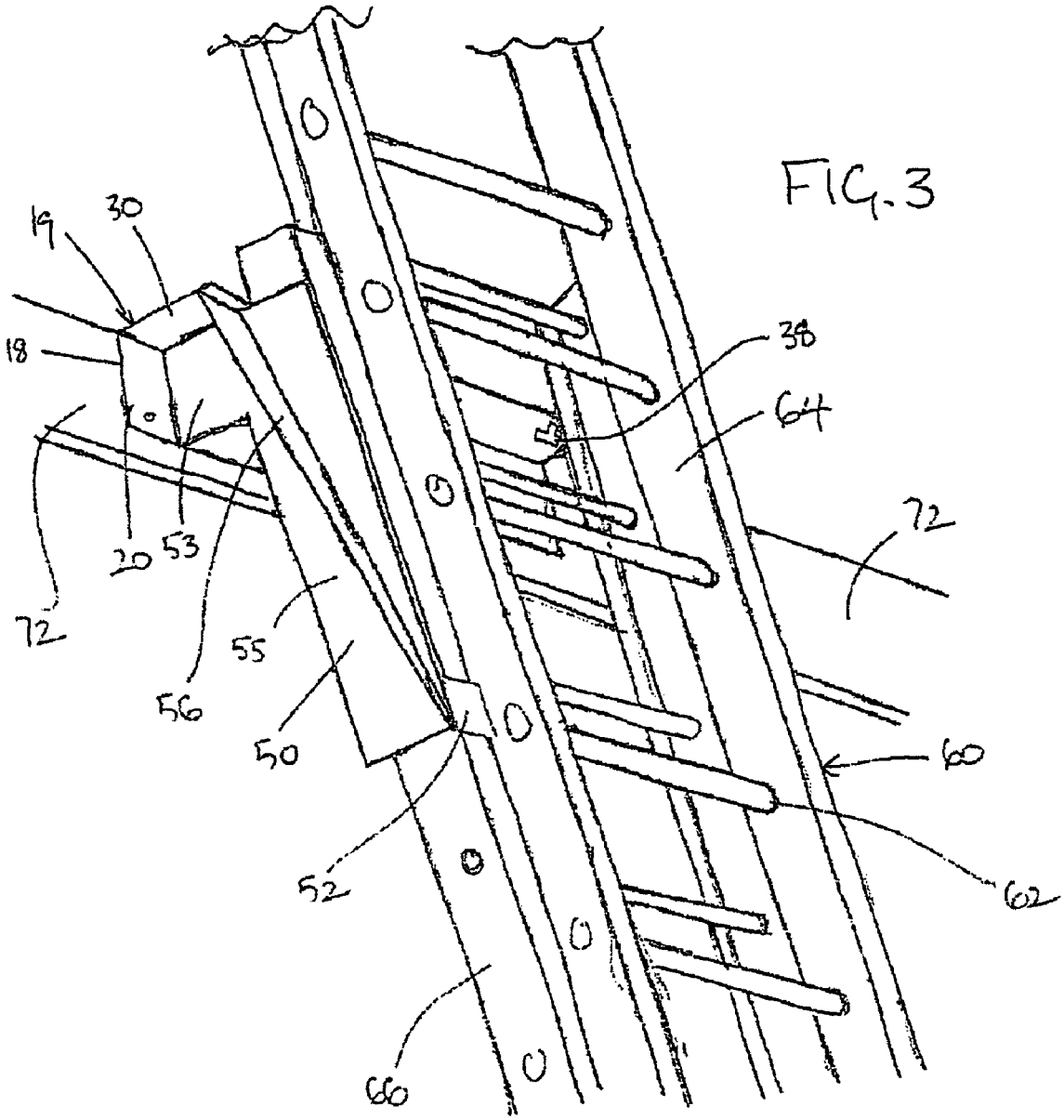
FIG. 3 is a left side perspective view of the stabiliser device with the ladder in a different position.

The stabiliser is designed to accommodate all forms of step ladders, including extension ladders as shown in FIGS. 2 and 3. This is enabled by the plate 20 being recessed from the edge 40, typically by 8 cm, to define a space 58 to the rear of the edge 40 and in which an upper end of lower ladder beams 66 may fit in the circumstance where an upper beam 64 is in engagement with the stabiliser 10. In contrast, FIG. 3 shows the situation where the lower beam 66 is engaged with the stabiliser 10 with the tab 52 and return lip 54 passing about the lower beam 66. This arrangement is necessitated by the construction of the extension ladder 60 with the upper beams 64 having a narrower spacing than the lower beams 66 such that the stabiliser 10 is not able to engage both upper 64 and lower beams 66 at the same time.

As mentioned previously, the stabiliser 10 is suited for having the panel 30 to fit partially over a floor 80 and for having the panel 20 abutting exposed joist 72 elevated from an adjacent floor in a multi-storey building under construction (FIG. 2). While this arrangement is preferred, it will be appreciated that a floor 70 in combination with exposed joist 72 may not be available at a given site. In such circumstances, a modified form of the stabiliser will be required. For instance, the stabiliser may be adapted to be anchored to a joist only and still include a modified arm 50 with tab 52 and return lip 54 for engaging with a ladder to stabilize it. In an alternative embodiment, where no suitable support can be found at an elevated point on which to place the stabiliser, the plate assembly 19 may be modified for fastening to a floor 70 such that arm 50 projects upwardly and tab 52 engages a ladder near the heel 68.

It will be understood that the invention disclosed and defined herein extends to all alternative combinations of two or more of the individual features mentioned or evidence from the text or drawings. All of these different combinations constitute various alternative aspects of the invention.

The claims defining the invention are as follows:

1. A ladder stabilising device comprising:

a body including a pair of plates, one being a floor-engaging plate with a front edge and an opposite edge and the other being a joist-engaging plate, the pair of plates being connected together substantially at a right angle with the joist-engaging plate depending from the floor-engaging plate intermediate the front edge and the opposite edge, and whereby the floor-engaging plate front edge defines an abutment edge for a rear face of a ladder having two beams and a plurality of spaced rungs extending between the beams wherein at least one of the plates of the pair of plates includes at least one aperture through which fastening means pass to enable the body to be fastened to an element of a structure prior to insertion of the ladder; and an arm connected to and projecting from said joist-engaging plate and having a projecting portion that projects outwardly and downwardly relative to said abutment edge when the body is engaged with said element of said structure, and further having a detent tab on said projecting portion being substantially parallel to said abutment edge and positioned to engage a beam of said ladder at a position downwardly along the ladder below said abutment edge so that the ladder is able to freely slide in between said detent tab and said abutment edge until engaged by said detent tab and said abutment edge which co-operate to limit outward sliding movement of the heel of the ladder;

wherein the detent tab is set relative to the body and thereby to said abutment edge to provide a predetermined initial ladder inclination when the ladder is engaging both the abutment edge and the detent tab.

2. A ladder stabilising device according to claim 1, wherein the detent tab includes a return which, in combination with the arm, defines a first slot in which the beam of the ladder is receivable, whereby said return assists in preventing lateral movement of the ladder out of engagement with the detent tab.

3. A ladder stabilising device according to claim 2, wherein the return extends from the detent tab by a distance which enables rungs of the ladder, when the beam of the ladder is engaged by the detent tab, to pass the return without interference, and which prevents the beam moving out of the first slot due to lateral movement of the ladder.

4. A ladder stabilising device according to claim 1, wherein the arm projects from the body at an inclination in the range of 9-20° from vertical whereby the predetermined initial ladder inclination is in the range of 9-20° from vertical.

5. A ladder stabilising device according to claim 1, wherein the floor-engaging plate and the joist-engaging plate are dimensioned and connected together to be respectively fastened to a floor surface and a joist.

6. A ladder stabilising device according to claim 5, wherein the plates are linked such that the floor-engaging plate defines an overhanging edge that forms said abutment edge for the ladder.

7. A ladder stabilising device according to claim 6, wherein the overhanging edge is from the joist-engaging plate to accommodate upper ends of lower beams of an extension ladder.

8. A ladder stabilising device according to claim 1, wherein said body further includes means fixed to, or adapted to be fixed to, said body to limit lateral movement of said ladder.

9. A ladder stabilising device according to claim 8, wherein said limiting means comprises a formation defining a slot on the body to receive a leg of the ladder.

10. A ladder stabilising device according to claim 9, wherein the formation is a lug or other projection positioned on one or more of said plates of said body to define the slot between the lug or other projection and said arm.

11. A ladder stabilising device according to claim 1, wherein the aperture is in the floor-engaging plate, whereby means may be threaded and passed about a second leg of the ladder, between rungs, whereby to loosely secure the second leg to the stabiliser device.

12. A ladder stabilising device according to claim 11, wherein the threaded means is a chain securable in a loop by a lock.

13. A ladder stabilising device according to claim 1, wherein the arm is 30 to 100 cm in length.

14. A ladder stabilising device according to claim 1, wherein the arm is about 40-50 cm in length.

15. A ladder stabilising device according to claim 2, wherein the floor-engaging plate and the joist-engaging plate are dimensioned and connected together to be respectively fastened to a floor surface and a joist.

16. A ladder stabilising device according to claim 15, wherein the plates are linked such that the floor-engaging plate defines an overhanging edge that forms said abutment for the ladder.

17. A ladder stabilising device according to claim 15, wherein said body further includes means fixed to, or adapted to be fixed to, said body to limit lateral movement of said ladder.

18. A ladder stabilising device according to claim 17, wherein the limiting means is a lug or other projection positioned on one or more of said plates of said body to define the slot between the lug or other projection and said arm.

19. A ladder stabilising device according to claim 1, wherein said arm is a flat piece of steel sheet with its plane oriented vertically when said body of the device is engaged with said element of said structure.

20. A ladder stabilising device according to claim 2, wherein said arm is a flat piece of steel sheet with its plane oriented vertically when said body of the device is engaged with said element of said structure.

21. A ladder stabilising device according to claim 5, wherein said arm is a flat piece of steel sheet with its plane oriented vertically when said body of the device is engaged with said element of said structure.

22. A ladder stabilising device according to claim 15, wherein said arm is a flat piece of steel sheet with its plane oriented vertically when said body of the device is engaged with said element of said structure.

23. A ladder stabilising device according to claim 1, wherein the length of the projecting portion is in the range of 40-50 cm.

24. A stabilised ladder installation including:

a ladder stabilising device fastened to a first element of a structure at a first workspace elevated from a second workspace, said ladder stabilising device including a body including a pair of plates, one being a floor-engaging plate with a front edge and an opposite edge and the other being a joist-engaging plate, being connected together substantially at right angle with the joist-engaging plate depending from the floor-engaging plate intermediate from the front edge and the opposite edge, whereby the floor-engaging plate is engaged stably with a floor surface of the structure, and defines an abutment edge for a rear face of a ladder having two side beams and a plurality of rungs extending between the beams; and an arm connected to and projecting from said joist-engaging plate having a projecting portion that projects outwardly and downwardly relative to said abutment edge, and further having a detent tab positioned to engage a side beam of said ladder at a position downwardly along the ladder below said abutment edge so that the ladder is able to slide in between said detent tabs and abutment edge until engaged by said detent tab and said abutment edge which co-operate to limit outward sliding movement of the heel of the ladder; and a ladder engaged with said abutment edge and with said detent tab and thereby stabilised substantially at a predetermined inclination.

25. A stabilised ladder installation according to claim 24, wherein the detent tab includes a return which, in combination with the arm, defines a first slot in which the beam of the ladder is received, whereby said return assists in preventing lateral movement of the ladder out of engagement with the detent tab.

26. A stabilised ladder installation according to claim 25, wherein the return extends from the detent tab by a distance which enables rungs of the ladder, when the beam of the ladder is engaged by the detent tab, to pass the return without interference, and which prevents the beam moving out of the slot due to lateral movement of the ladder.

27. A stabilised ladder installation according to claim 26, wherein the detent tab is spaced from the body by a distance which facilitates insertion of a ladder into the device and which optimizes the weight and strength of the device.

* * * * *